United States Patent [19]
Focke et al.
[11] 4,402,403
[45] Sep. 6, 1983

[54] GUSSETED POUCH, ESPECIALLY FOR RECEIVING CUT TOBACCO

[75] Inventors: Heinz Focke; Oskar Balmer, both of Verden, Fed. Rep. of Germany

[73] Assignee: Focke & Co., Verden, Fed. Rep. of Germany

[21] Appl. No.: 335,490

[22] Filed: Dec. 30, 1981

[30] Foreign Application Priority Data

Dec. 31, 1980 [DE] Fed. Rep. of Germany ..... 3049601

[51] Int. Cl.[3] ..... A24F 23/02; B65D 33/00; B65D 85/00

[52] U.S. Cl. ..... 206/245; 150/7; 206/260; 229/62

[58] Field of Search ..... 150/7; 206/236, 242, 206/245, 260; 229/62

[56] References Cited

U.S. PATENT DOCUMENTS 2,325,673 8/1943 Gurwick ..... 206/245 X
2,506,311 5/1950 Moore ..... 206/245 X
3,380,576 4/1968 Deimann ..... 206/260
3,471,005 10/1969 Sexstone ..... 206/260

FOREIGN PATENT DOCUMENTS 251637 5/1964 Australia ..... 150/7
2705692 8/1977 Fed. Rep. of Germany ..... 150/7

*Primary Examiner*—William Price
*Assistant Examiner*—Sue A. Weaver
*Attorney, Agent, or Firm*—Sughrue, Mion, Zinn, Macpeak and Seas

[57] ABSTRACT

A gusseted pouch for cut tobacco is made from outer sheet blanks sandwiching an intermediate paper layer, folded to form a pocket with side walls. This causes an excess accumulation of material at the side edges in the region of the pouch pocket opening due to a plurality of layers of material. To counteract the difficulties resulting therefrom during the production of a closure for the pocket, recesses 28, 29, 30, 31 are provided in the paper blank at its lateral edges and corners.

5 Claims, 6 Drawing Figures

GUSSETED POUCH, ESPECIALLY FOR RECEIVING CUT TOBACCO

DESCRIPTION

Figure 2:
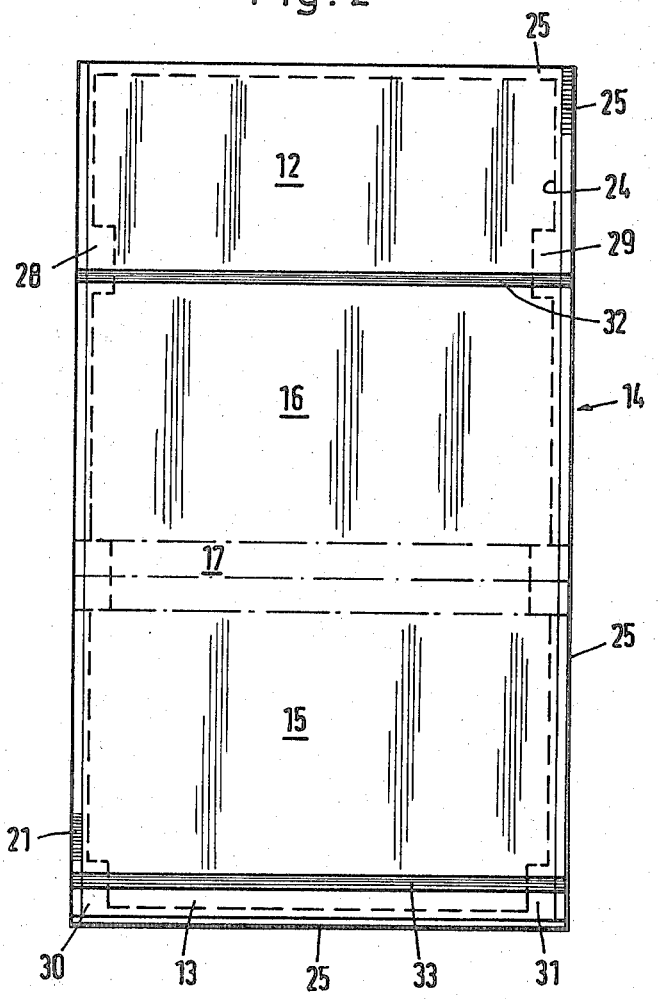

The invention relates to a gusseted pouch with a pocket open at the top, which is limited by front and rear walls and by side and bottom walls directed transversely to the latter, consisting of a pouch blank which is itself formed by at least two sheet blanks made of plastic which are connected to one another at their edges and between which an insert blank, especially a paper blank, is located, a closure flap adjoining the pocket in the region of the rear wall and a gripping flap adjoining it in the region of the front wall.

Cut tobacco is packaged predominantly in soft pouches of the type mentioned above or of a similar type. The gusseted pouches discussed here are a special form of the pouches, which are known in various designs.

The insert in the form of a paper blank, which is used in the pouch designs treated here, extends up to the edge of the pouch blank and, consequently, also over the region of the side walls. This gives rise to difficulties in the region of the orifice of the pocket because of the complex folding which exists there. The front and rear walls of the pocket, and the closure flap and gripping flap rest directly against one another in this region. The side walls are folded inwards in the form of a V. The accumulation of material arising as a result in the lateral regions is unfavourable for making the gusseted pouch and, above all, for a closure formed by a transverse welding seam.

Starting from this, the object on which the invention is based is to further develop and improve a gusseted pouch with an insert blank, especially a paper blank, in such a way that difficulties arising as a result of an accumulation of material are avoided in the region of the orifice of the pocket, particularly at the sides of this.

To achieve this object, the gusseted pouch according to the invention is characterised in that in the region of the closure flap and/or gripping flap the paper blank is made with lateral recesses.

The purpose of this measure is to reduce, in the critical region where the side walls are folded in, the accumulation of material caused by several plies being arranged in layers above one another. Accordingly, the paper blank is designed so that one paper ply is omitted in the region mentioned.

The paper blank is therefore provided with a plurality of recesses in the lateral region, which are arranged so that, once the pouch has been folded, they take effect laterally in the region of the orifice of the pocket and overlap one another wholly or partially. The width of these recesses in the paper blank, that is to say the dimension transverse to the pouch blank, corresponds approximately to half the width of the side wall, so that the front and rear walls as well as the closure flap and gripping flap are equipped with a paper blank over the full width in the region of the visible faces.

The omission of (two) pper plies at the end regions of the orifice of the pocket or at the end regions of a closing seam made here gives rise to a plurality of advantages. In the first place, in this region, the side wall can more easily be folded inwards in the form of a V between the front wall and rear wall. Since the closure flap is made conventionally over the full width of the pouch blank, a continuous marginal tab of this closure flap is folded over inwards over half the width of the side wall. Even this merging of the side wall into the folded-over marginal tab is improved as a result of the omission of the paper insert in this region.

The improvement in the closure of the pocket by means of a welding or sealing seam continuous over the full width is of particular importance. This seam is conventionally made by means of pressure pads, welding pads or the like, between which the region of the gusseted pouch to be closed is received. Because of the omission of the paper insert or a part of this, at the ends of the orifice to be closed a step formed by an accumulation of material and impairing compression of the respective pressure members over the full length is prevented or reduced. By means of the invention, it thus becomes possible to have a welding or sealing seam which is continuous over the full length with sufficient bonding of the walls.

Figure 1:
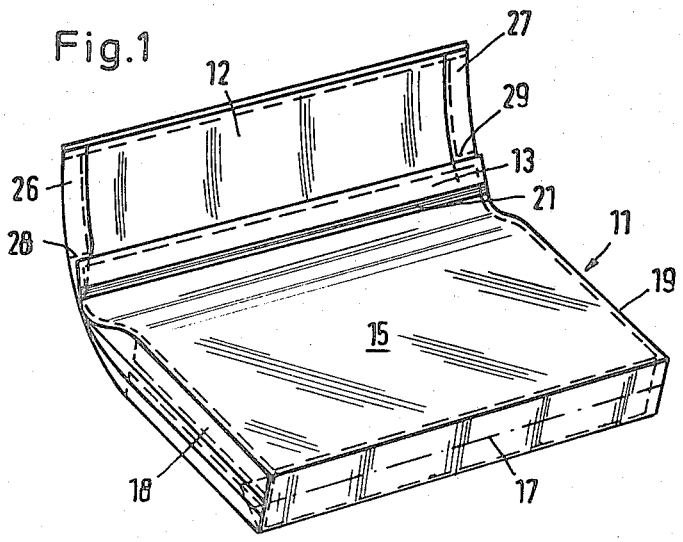
Figure 4:
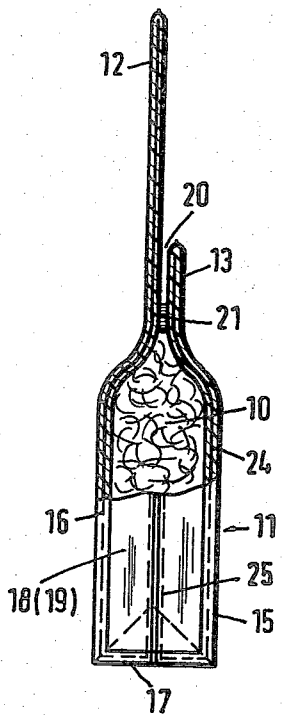
Figure 3:
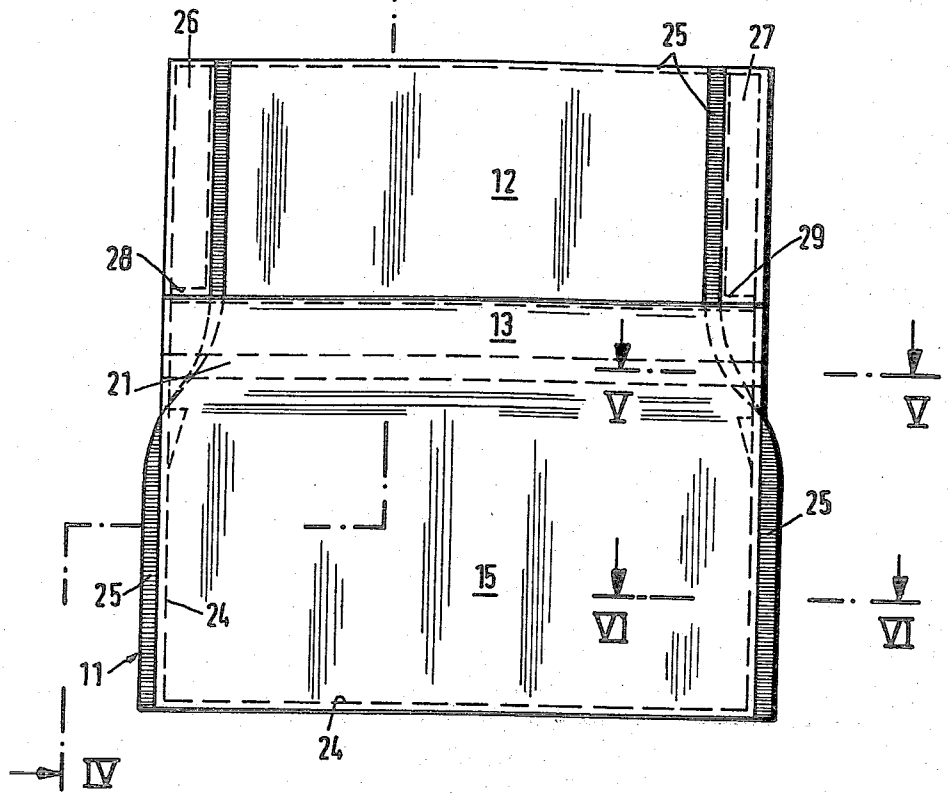
Figure 5:
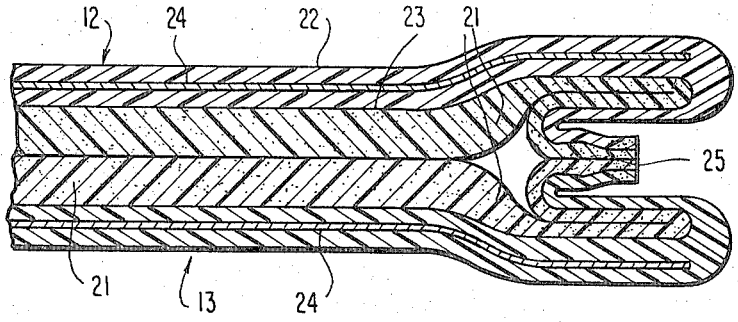
Figure 6:
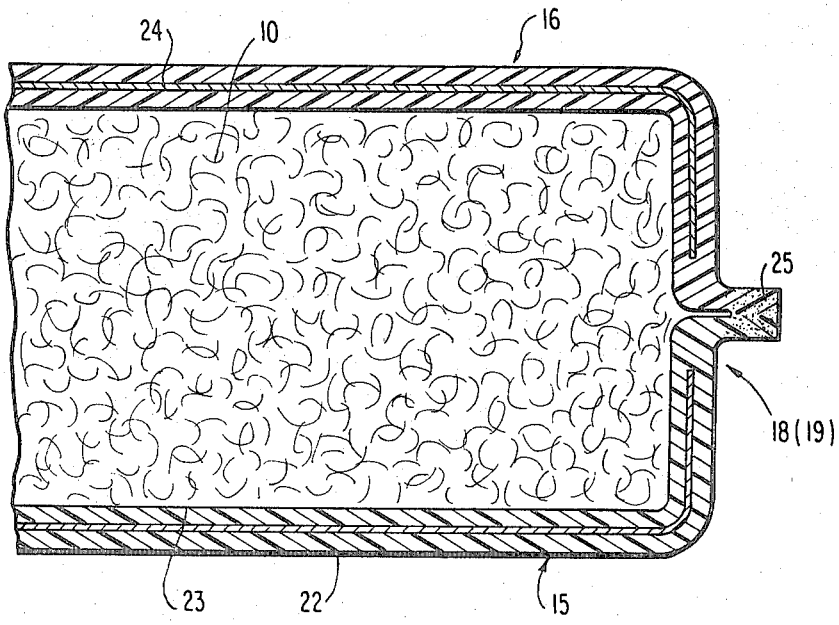

An exemplary embodiment of the invention is explained in more detail below with reference to the drawings in which:

FIG. 1 shows, in a perspective representation, a gusseted pouch with the closure flap folded back, FIG. 2 shows a pouch blank in a spread-out state, FIG. 3 shows a view of a gusseted pouch with the closure flap spread out, FIG. 4 shows a section along the line IV—IV in FIG. 3, FIG. 5 shows a section along the line V—V in FIG. 3, on a greatly enlarged scale, FIG. 6 shows a section along the line VI—VI in FIG. 3, also on a greatly enlarged scale.

The gusseted pouch illustrated in the drawings serves for receiving (cut) tobacco 10. This is received in a pocket 11 which is formed, together with a closure flap 12 and a gripping flap 13, from a multiply rectangular pouch blank 14 (FIG. 2).

The pocket 11 is limited by a front wall 15, a rear wall 16, a bottom wall 17 transverse thereto and side walls 18 and 19 also directed transversely. Accordingly, when filled, the pocket 11 has a predominantly cuboid shape.

The relatively long closure flap 12 adjoining the rear wall 16 and the gripping flap 13 adjoining the front wall 15 limit an orifice 20 in the pocket 11 which is closed before use, namely by a transverse welding seam 21. The closure flap 12 and the gripping flap 13 extend over the free or open side of the pocket 11 limited in this way. In the end position of the gusseted pouch, the closure flap 12 (together with the gripping flap 13) is folded over against the front wall 15 of the pocket 11 and, if appropriate, is fixed here.

The pouch blank 14, as a starting product for the gusseted pouch, consists of several, namely three plies. Located between outer sheet blanks 22 and 23 is an insert in the form of a paper blank 24. This has smaller dimensions than the sheet blanks 22, 23 which are connected to one another all the way round at the edges by welding seams 25. However, with the exception of the welding seams 25, the paper blank 24 extends (predominantly) over the full width of the pouch blank 14.

In the region of the orifice 20, the construction causes complex folds to be made at the sides. Here, the front and rear walls 15, 16 are brought together until they rest against one another. At the same time, the side walls 18, 19 are folded inwards in the form of a V between the front wall 15 and rear wall 16 or between the closure flap 12 and gripping flap 13. In the free region of the above-mentioned flaps, the excess of material arising because of the lack of side walls 18, 19 here is used up by the formation of marginal tabs 26, 27 folded over inwards. The gusseted pouch thus has the same width over its full extent. In the region where the side walls 18, 19 merge into the marginal tabs 26, 27 mentioned, several plies of material arise here as the result of folding in in the form of a V.

In the present gusseted pouch, the adverse effect of these is avoided or reduced by providing recesses 28 and 29 as well as 30 and 31 in the paper blank 24. The recesses 28 to 31 mentioned are located in the region of the orifice 20 of the pocket 11. This means that in the region of the closure flap 12 the paper blank 24 has recesses 28, 29 open only to the sides. On the other hand, in the region of the gripping flap 13, namely at the free edge of this, there are recesses 30, 31 open to the sides and to the free edge. Once the pouch has been folded or closed, the above-mentioned recesses 28 to 31 lie opposite and substantially coincidental with one another. The width of the recesses 28 to 31, that is to say the dimension in the transverse direction of the pouch blank 14, is cut, here, to half the width of the side walls 18, 19, so that the front wall 15 and rear wall 16 reveal a paper blank 24 over the full width.

As a result of the recesses 28 to 31, one paper ply is omitted on each side in the region of the V-shaped folding-in of the side walls 18, 19. This omission of two plies of material causing trouble here emerges especially from FIG. 5. Here, the folded-in plies of the sheet blanks 22, 23 rest directly against one another and can, if required, be welded to one another over several plies. The thickening of material arising in this region is thereby reduced considerably.

FIG. 2 indicates the position of the welding seam 21. It is possible, in the region of this, to attach to the inside of the pouch blank 14 tapes of material, for example hot-melt tapes 32, 33, which can be activated. When the pouch has been folded, to make the welding seam 21 these are activated as a result of compression and the application of heat, so that an openable closing seam is obtained.

Alternatively to the exemplary embodiment illustrated, the recesses 28 and 29 in the region of the closure flap 12 can, in a similar way to the gripping flap 13, extend up to the free edge. In this case, the marginal tabs 26, 27 of the closure flap 12, which are folded inwards, are also made without a paper ply.

Because of the fold construction in the side region described, it is expedient to locate the welding seam 21 or the hot-melt tapes 32, 33 off-centre in relation to the recesses 28 to 31—with regard to their transversely directed centre axis. As is evident from FIG. 2, the hot-melt tapes 32, 33 are arranged offset towards the interior of the pocket 11. This results in the best possible effect of the recesses 28 to 31.

The special feature of the present design of a gusseted pouch is that there is only one paper ply for each wall over the entire width of the closing seam or welding seam 21. Consequently, the resistance values during thermal welding or even during high-frequency welding are substantially the same over the full length of the closing seam.

We claim:

1. Gusseted pouch with a pocket open at the top, which is limited by front and rear walls and by side and bottom walls directed transversely to the latter, consisting of a pouch blank which is itself formed by at least two sheet blanks made of plastic which are connected to one another at their edges and between which an insert blank, especially a paper blank, is located, a closure flap adjoining the pocket in the region of the rear wall and a gripping flap adjoining it in the region of the front wall, characterised in that in the region of the closure flap and/or gripping flap (12, 13) the paper blank (24) is provided with lateral recesses (28, 29; 30, 31).

2. Gusseted pouch according to claim 1, characterised in that the recesses (28, 29; 30, 31) are made over half the width of the side walls (18, 19) of the pocket (11).

3. Gusseted pouch according to claim 1 or 2, characterised in that the recesses (28, 29; 30, 31) extend at least over the region of a closing seam (welding seam 21) closing the pocket (11), or to the ends of this seam.

4. Gusseted pouch according to claims 1 or 2, characterised in that in the region of the front wall (15) or of the gripping flap (13) the recesses (30, 31) are open towards the free edge of this.

5. Gusseted pouch according to claim 3, characterised in that the welding seam (21) is arranged off-centre in relation to the recesses (28, 29; 30, 31), namely offset towards the pocket (11).

* * * * *